US007896780B2

(12) United States Patent
Chen

(10) Patent No.: US 7,896,780 B2
(45) **Date of Patent: *Mar. 1, 2011**

(54) STEPPER

(75) Inventor: Tsung-Jen Chen, Chiayi (TW)

(73) Assignee: Hui-Chen Chen, Chiayi (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/432,202

(22) Filed: Apr. 29, 2009

(65) Prior Publication Data

US 2009/0291808 A1 Nov. 26, 2009

(30) Foreign Application Priority Data

May 23, 2008 (TW) ..... 97208992 U

(51) Int. Cl.
*A63B 22/04* (2006.01)

(52) U.S. Cl. ..... 482/52

(58) Field of Classification Search ..... 482/51, 482/52, 53, 54, 70, 71, 148; 434/253, 255; 601/29, 31, 34, 35; D21/670
See application file for complete search history.

(56) References Cited

U.S. PATENT DOCUMENTS

| | | | | |
|---|---|---|---|---|
| 6,955,634 | B1 * | 10/2005 | Lat | 482/71 |
| 7,465,255 | B2 * | 12/2008 | Chen | 482/53 |
| 2005/0113215 | A1 * | 5/2005 | Chuang | 482/52 |
| 2005/0239606 | A1 * | 10/2005 | Lin | 482/52 |
| 2007/0142182 | A1 * | 6/2007 | Yang et al. | 482/52 |
| 2007/0270284 | A1 * | 11/2007 | Lin | 482/52 |
| 2008/0207406 | A1 * | 8/2008 | Tsai | 482/52 |
| 2009/0270229 | A1 * | 10/2009 | Chen | 482/52 |

* cited by examiner

*Primary Examiner*—Loan Thanh
*Assistant Examiner*—Tam Nguyen
(74) *Attorney, Agent, or Firm*—Banger Shia

(57) ABSTRACT

A stepper includes a base, two axles, two pedal units and a coordinating unit. The axles are provided on the base so that they point downwards as they extend away from each other. Two pedal units each pivotally connected to a related one of the axles. The coordinating unit includes a lever and two connectors. The lever is pivotally connected to the base. Each of the connectors is used to connect the lever to a related one of the pedal units.

5 Claims, 9 Drawing Sheets

STEPPER

FIELD OF INVENTION

The present invention relates to a stepper with which a user can exercise his or her legs, buttocks and waist.

BACKGROUND OF INVENTION

A conventional stepper includes two pedals that can be pivoted up and down about horizontal axles. The movement of the pedals is limited to vertical directions. Therefore, a user can only exercise his or her legs.

Another conventional stepper includes two pedals that can be pivoted about two inclined axles extended from a post. The inclined axles and the post form a Y-shaped structure. One of the pedals will be lifted and moved towards the post if the other pedal is trodden and moved away from the post, i.e., outwards. Therefore, a user is forced to twist his or her waist while exercising his or her legs by treading the pedals. The user uses a little energy to twist his or her waist because he or she easily keeps balance while moving the pedal downwards and outwards.

The present invention is therefore intended to obviate or at least alleviate the problems encountered in prior art.

SUMMARY OF INVENTION

It is the primary objective of the present invention to provide a stepper with which a user can exercise his waist, buttocks and legs at the same time.

To achieve the foregoing objective, the stepper includes a base, two axles, two pedal units and a coordinating unit. The axles are provided on the base so that they point downwards as they extend away from each other. Each of the pedal units is pivotally connected to a related one of the axles. The coordinating unit includes a lever and two connectors. The lever is pivotally provided on the base. Each of the connectors is used to connect the lever to a related one of the pedal units.

Other objectives, advantages and features of the present invention will be apparent from the following description referring to the attached drawings.

BRIEF DESCRIPTION OF DRAWINGS

The present invention will be described via the detailed illustration of eight embodiments referring to the drawings.

DETAILED DESCRIPTION OF EMBODIMENTS

Figure 1:
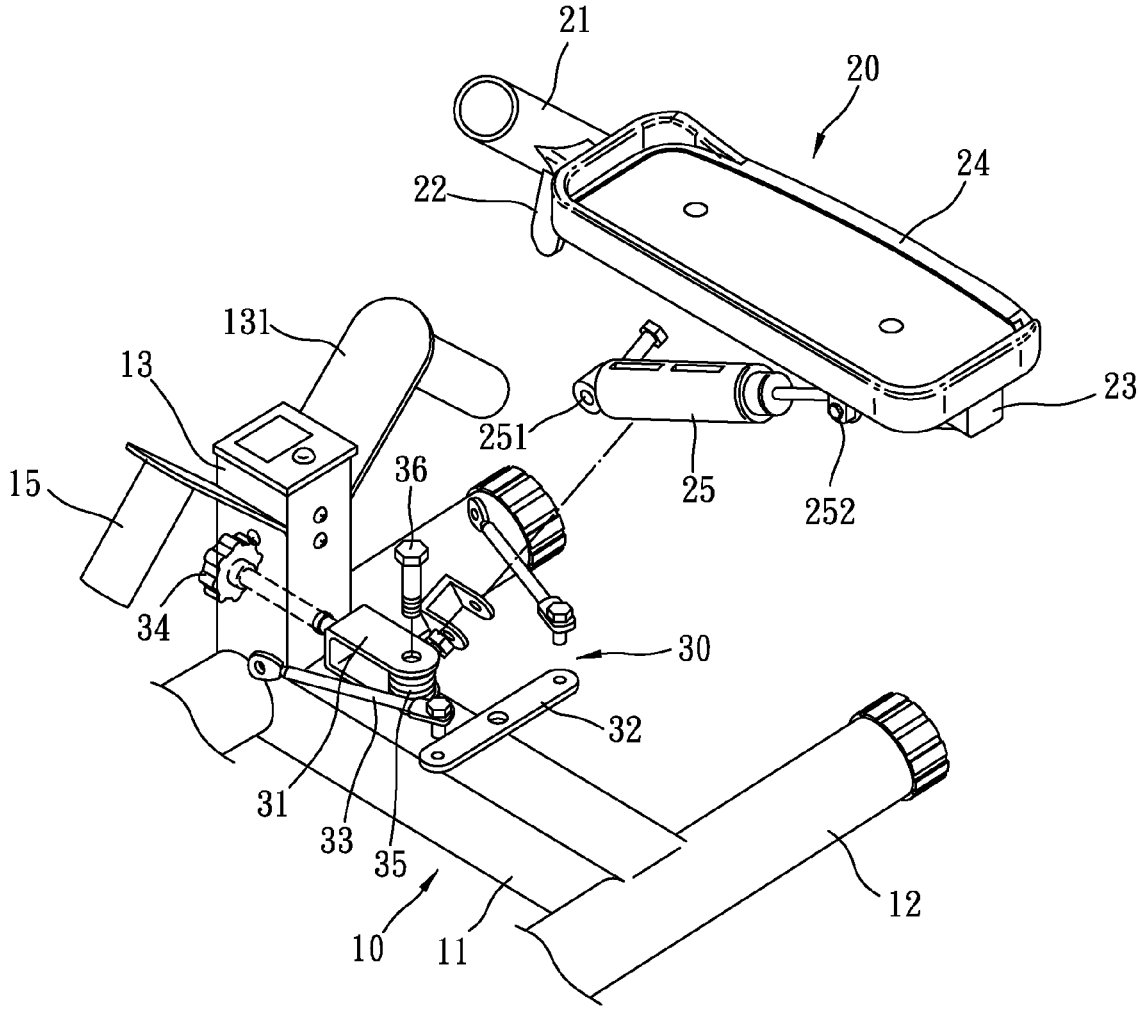
FIG. 1 is an exploded view of a compact stepper according to the first embodiment of the present invention.
Figure 2:
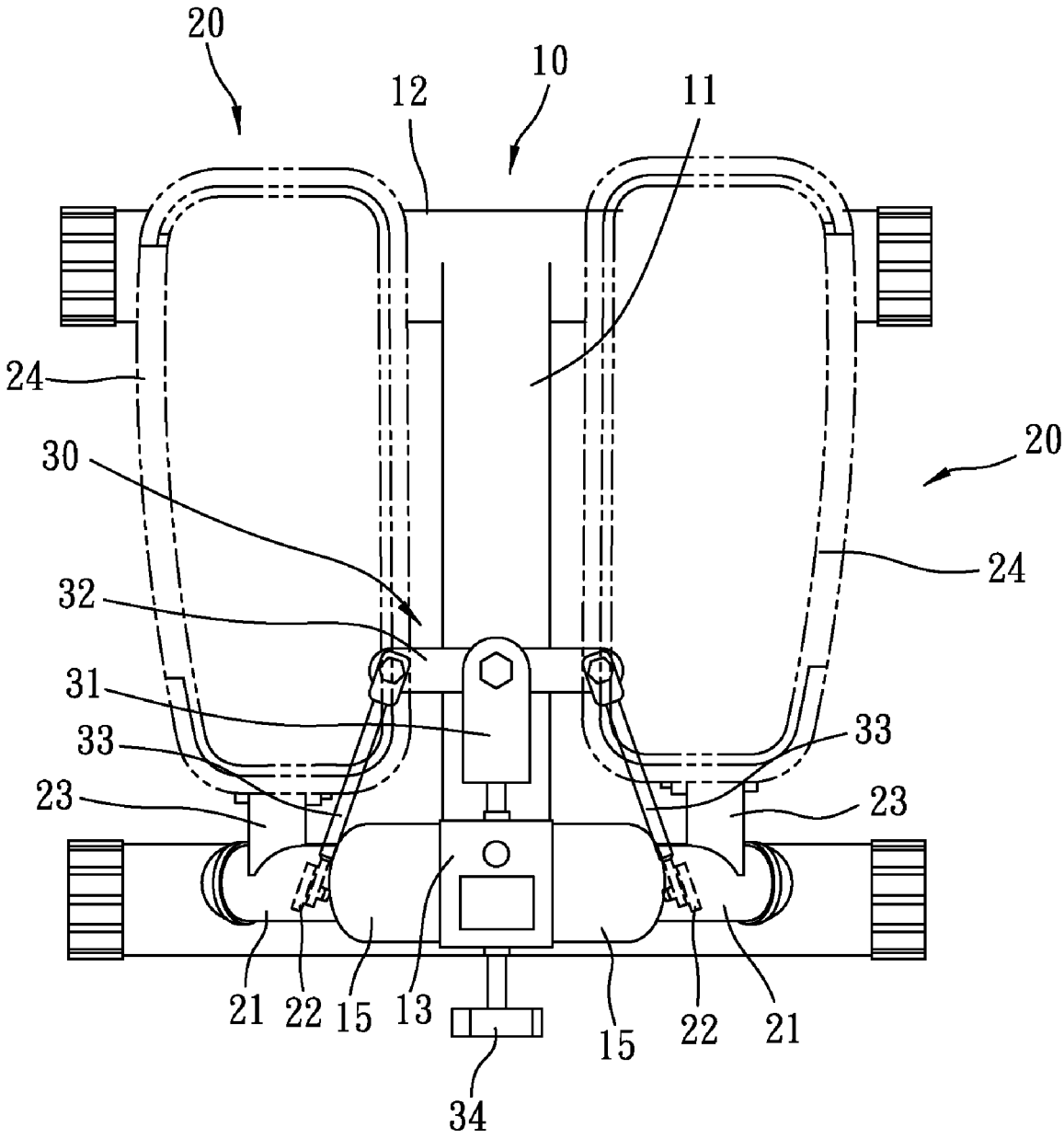
FIG. 2 is a top view of the compact stepper shown in FIG. 1.

Referring to FIGS. 1 and 2, a stepper includes a base 10, two pedal units 20, a coordinating unit 30 and two impeding elements 25 according to a first embodiment of the present invention. The base 10 includes a longitudinal bar 11 and two crossbars 12 each connected to an end of the longitudinal bar 11. A post 13 is raised from one of the crossbars 12, two wings 131 extended upwards from the post 13. An axle 15 is extended downwards from each of the wings 131. Each of the axles 15 includes a fixed end at a related one of the wings 131 and located lower than the fixed end.

Each of the pedal units 20 includes a sleeve 21 pivotally provided on a related one of the axles 15, a crank 22 extended from the sleeve 21, a beam 23 connected to the sleeve 21, a pedal 24 provided on the beam 23 and a connector 36 connected to the sleeve 21. Thus, the pedals 24 are pivotally provided on the axles 15.

Each of the impeding elements 25 may be a spring or a hydraulic or pneumatic cylinder. Each of the impeding elements 25 includes an end connected to one of the crossbars 12 with a universal joint 251 and an opposite end connected to a related one of the beams 23 with a universal joint 252. Thus, each of the impeding elements 25 is used to exert impedance against the movement of a related one of the pedal units 20.

The coordinating unit 30 includes a frame 31, a lever 32, two connectors 33, an adjusting element 34, washers 35 and a fastener 36. The frame 31 is connected to the post 13 with the adjusting element 34 so that the distance between the frame 31 and the post 13 is adjustable by operating the adjusting element 34. The adjusting element 34 includes preferably a threaded bolt and a knob attached to the threaded bolt. The frame 31 includes preferably two ears. The washers 35 are located between the ears of the frame 31. The lever 32 is located between the washers 35. The fastener 36 is driven through the ears of the frame 31, the washers 35 and the lever 32 so that the lever 32 is pivotally connected to the frame 31. Each of the connectors 33 includes an end pivotally connected to an end of the lever 32 and an opposite end pivotally connected to a related one of the cranks 22. Thus, the pedal units 20 are interconnected so that one of the pedals 24 will be moved upwards and outwards if the other pedal 24 is moved downwards and inwards.

A user has to exercise his or her legs, buttocks, waist and even arms to keep balance in treading one of the pedals 24 downwards and inwards. Therefore, the user can exercise various muscles and consume much energy with the stepper.

Figure 3:
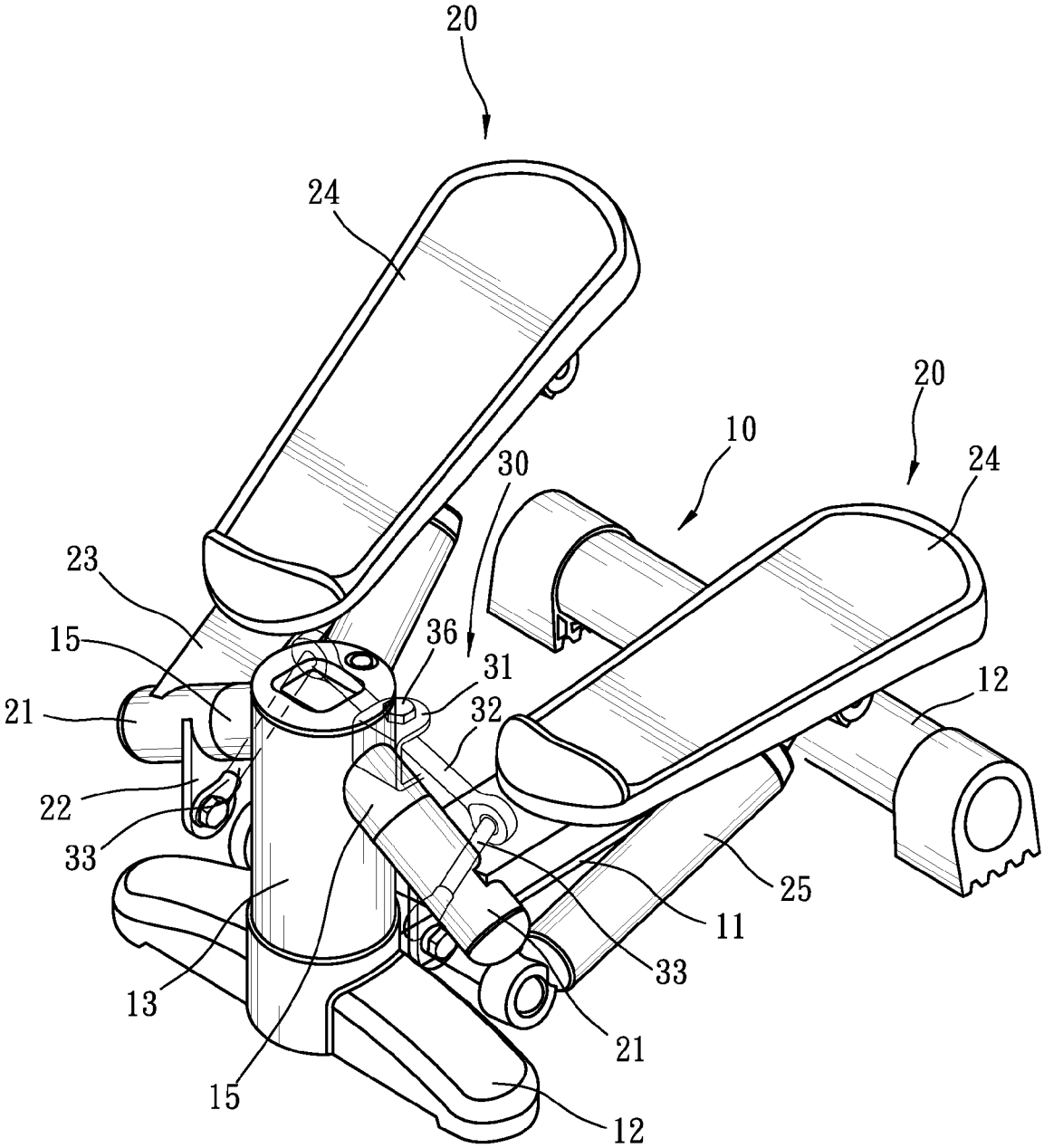
FIG. 3 is a perspective view of a compact stepper according to the second embodiment of the present invention.

Referring to FIG. 3, there is shown a stepper according to a second embodiment of the present invention. The second embodiment is like the first embodiment except the following features. The wings 131 are omitted. The frame 31 is attached to the post 13 by welding for example. Hence, the adjusting element 34 is omitted.

Figure 4:
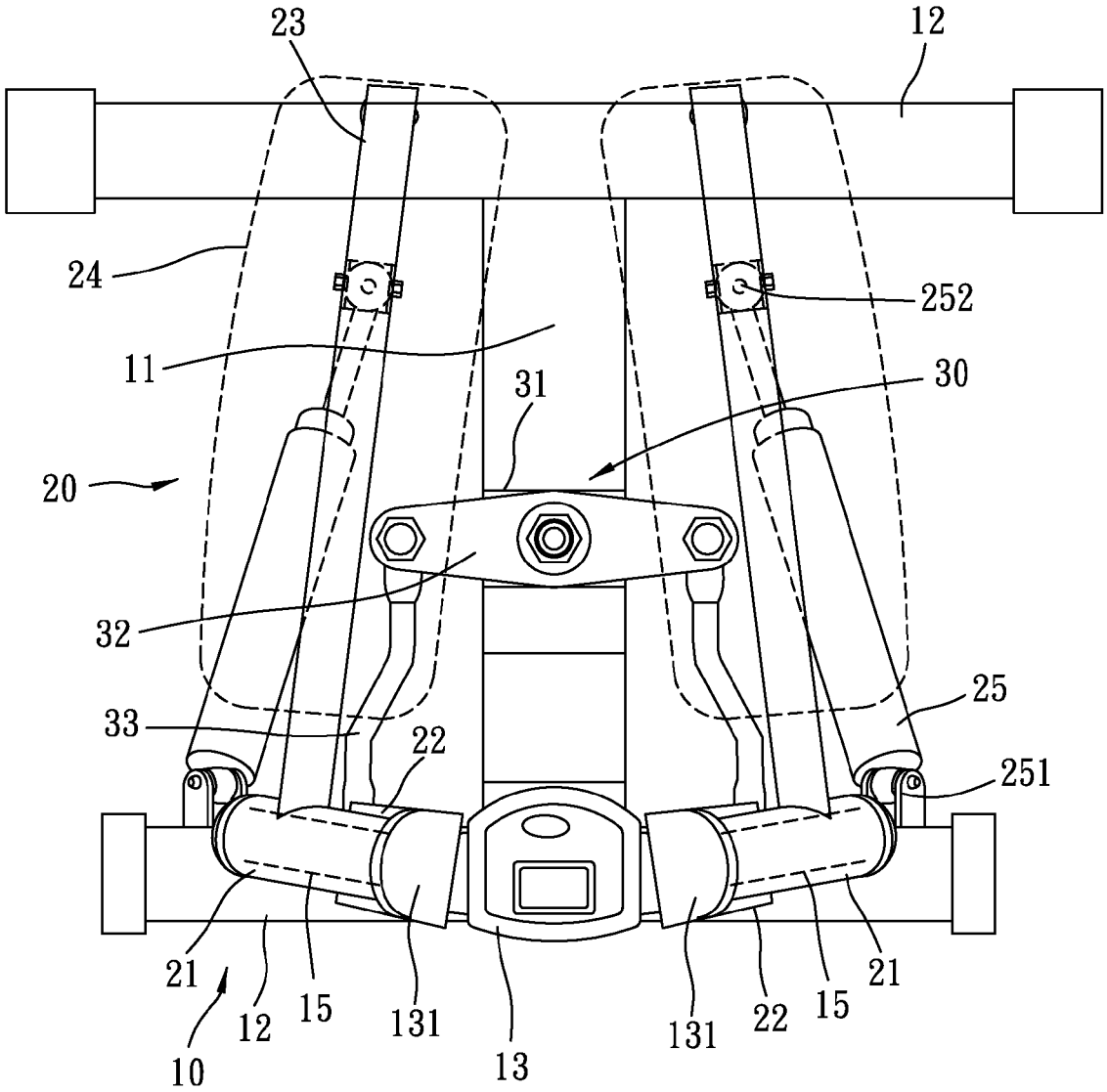
FIG. 4 is a top view of a compact stepper according to the third embodiment of the present invention.

Referring to FIG. 4, there is shown a stepper according to a third embodiment of the present invention. The third embodiment is like the second embodiment except that the frame 31 is attached to the longitudinal bar 11.

Figure 5:
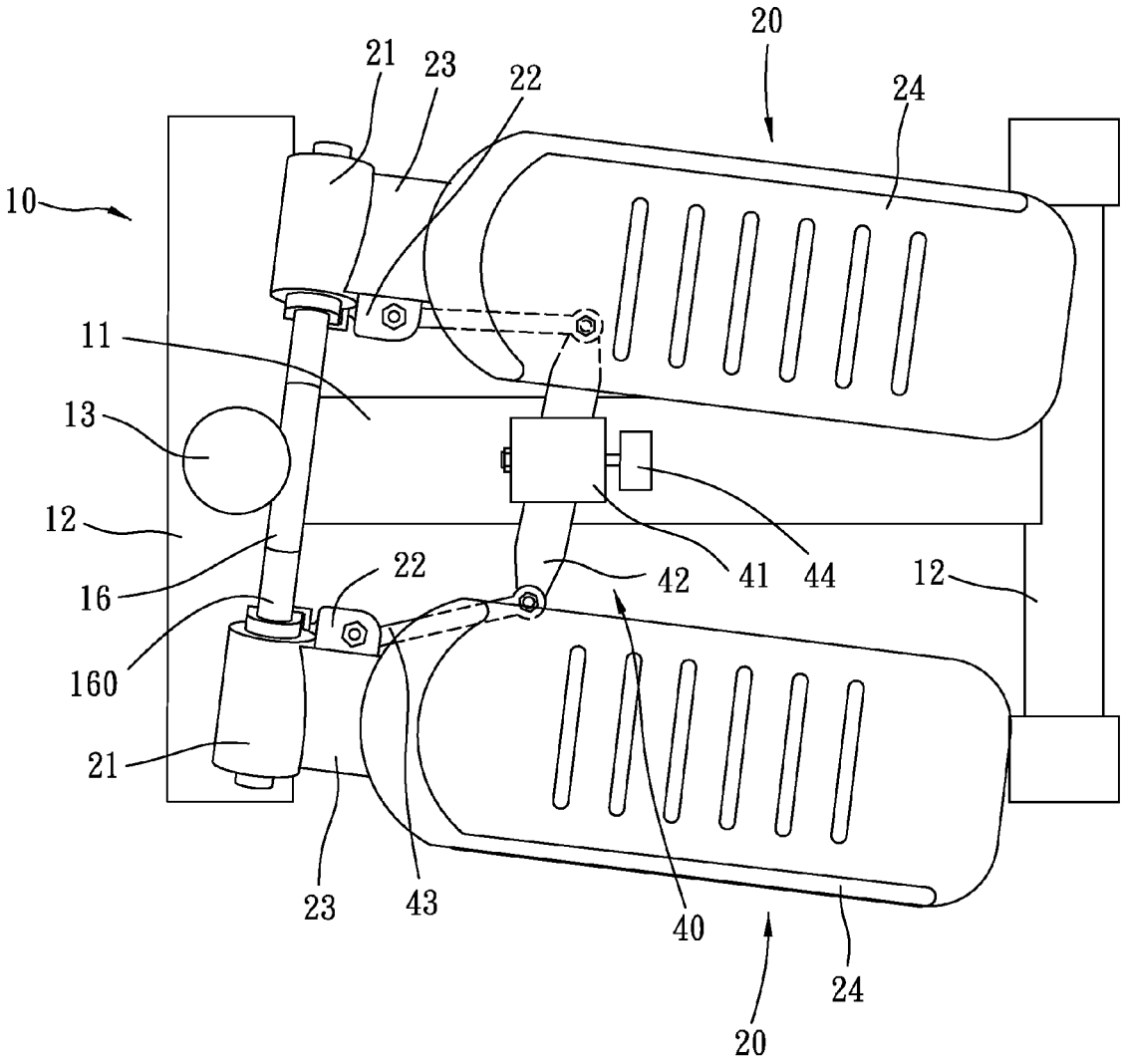
FIG. 5 is a top view of a compact stepper according to the fourth embodiment of the present invention.

Referring to FIG. 5, there is shown a stepper according to a fourth embodiment of the present invention. The third embodiment is like the first embodiment except the following features. A bar 16 is used instead of the wings 131 and axles 15. The bar 16 includes a middle section attached to the post 13 and two terminal sections 160 inserted though the sleeves 21. A coordinating unit 40 is used instead of the coordinating unit 30. The coordinating unit 40 includes a frame 41, a lever 42, two connectors 43 and an adjusting element 44. The frame 41 is attached to the longitudinal bar 11. The lever 42 is connected to the frame 41. Each of the connectors 43 includes an end pivotally connected to an end of the lever 42 and an opposite end pivotally connected to a related one of the cranks 22. The adjusting element 44 is driven though the frame 41 and connected to the lever 42 so that the position of the lever 42 relative to the frame 41 is adjustable by operating the adjusting element 44.

Figure 6:
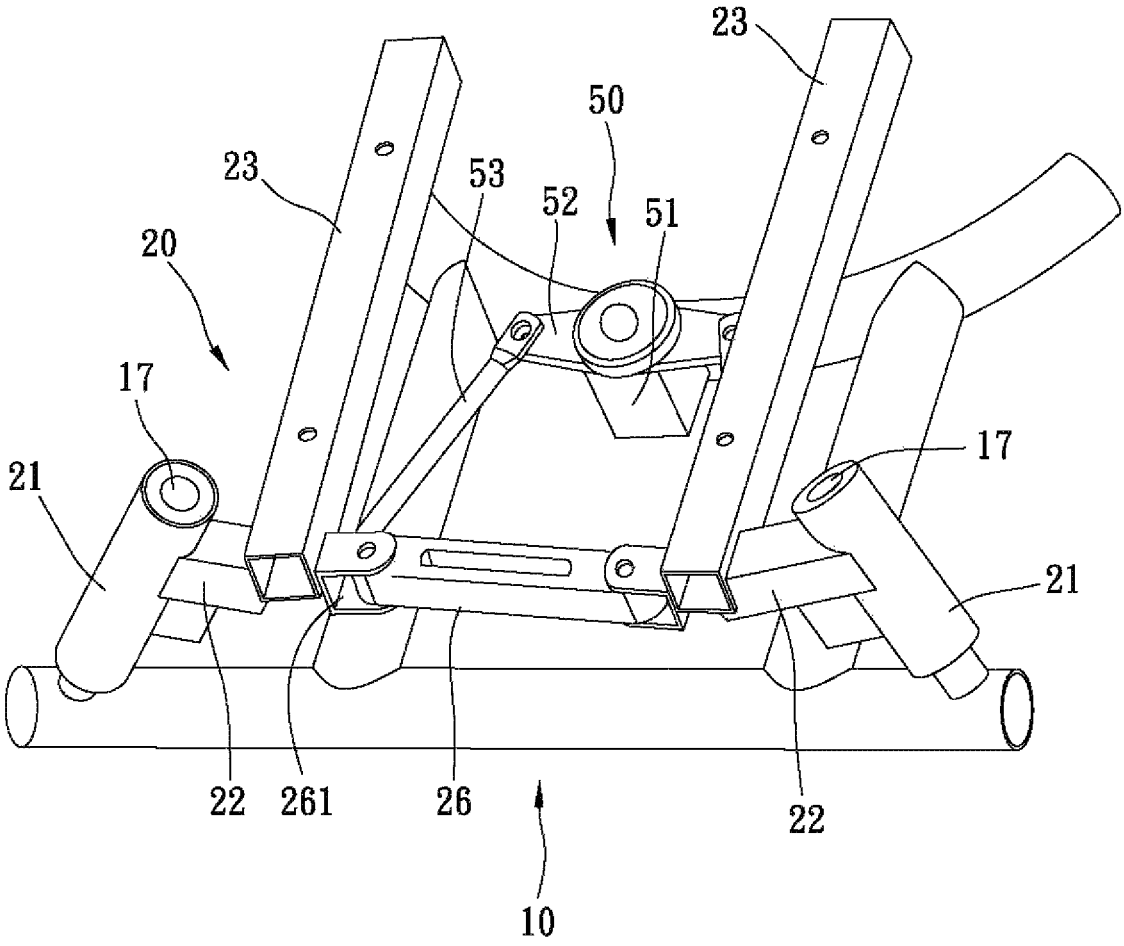
FIG. 6 is a partial perspective view of a compact stepper according to the fifth embodiment of the present invention.

Referring to FIG. 6, there is shown a stepper according to a fifth embodiment of the present invention. The fifth embodiment is like the first embodiment except the following features. There are two axles 17 extended from one of the crossbars 12. The sleeves 21 are pivotally supported on the axles 17. Hence, the post 13, the wings 131 and the axles 15 are omitted. Each of the axles 17 includes an upper end and a lower end. The distance between the upper ends of the axles 17 are shorter than the distance between the lower ends of the axles 17. A coordinating unit 50 is used instead of the coordinating unit 30. The coordinating unit 50 includes a frame 51, a lever 52 and two connectors 53. The frame 51 is connected to the other crossbar 12. The lever 52 is pivotally connected to the frame 51. Each of the connectors 53 includes an end pivotally connected to an end of the lever 52 and an opposite end pivotally connected to a related one of the cranks 22. In each of the pedal units 20, the beam 23 is connected to the crank 22 instead of the sleeve 21. An impeding element 26 is used instead of the impeding element 25. The impeding element 26 is an elastic element formed with two ends each connected to one of the beams 23 via a universal joint 261. The impeding element 26 exerts impedance against the movement of each of the pedals 24.

Figure 7:
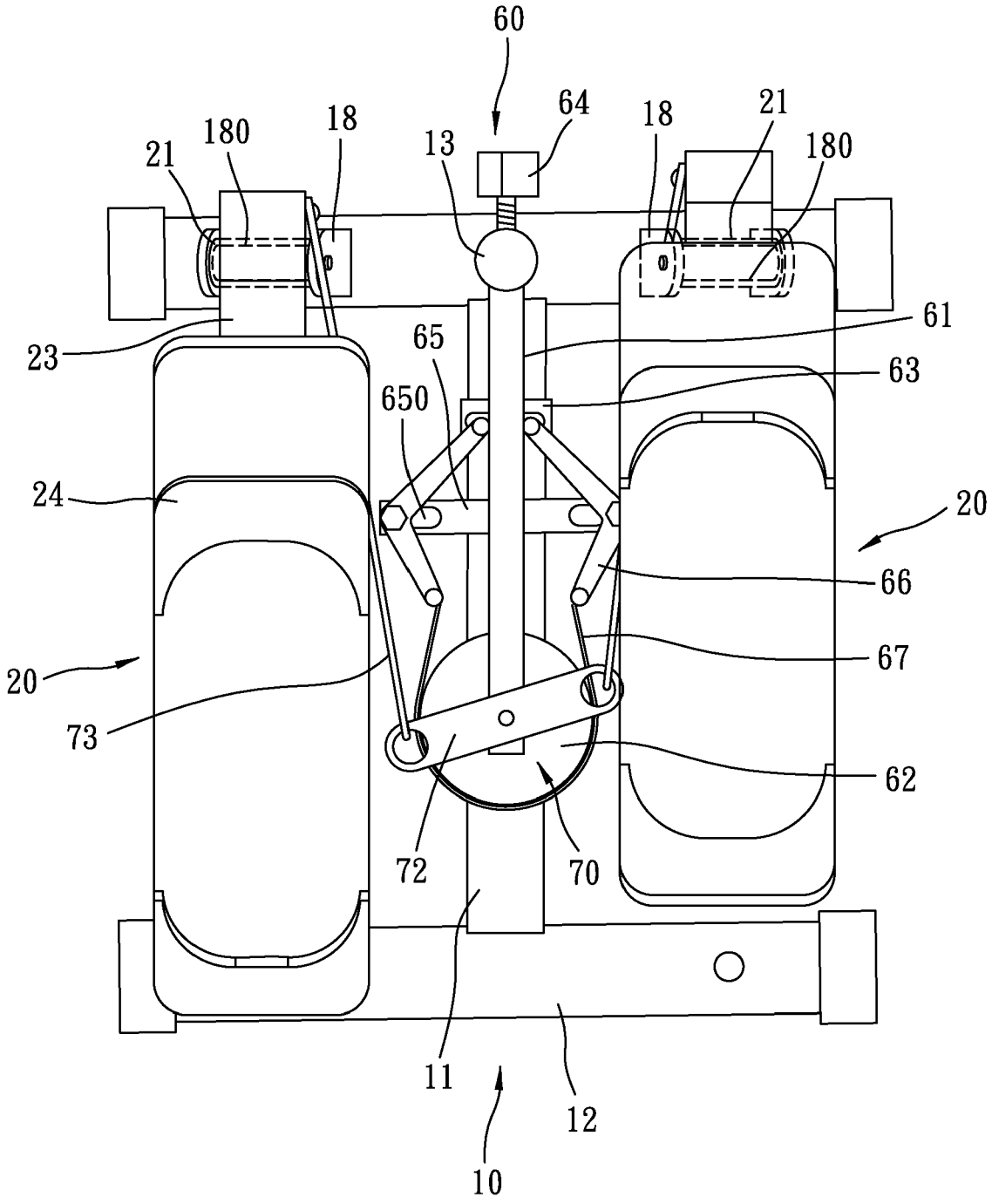
FIG. 7 is a top view of a compact stepper according to the sixth embodiment of the present invention.

Referring to FIG. 7, there is shown a stepper according to a sixth embodiment of the present invention. The sixth embodiment is like the first embodiment except the following features. Two pairs of ears 18 are provided on one of the crossbars 12. An axle 180 is supported on each pair of ears 18. Therefore, the wings 131 and the axles 15 are omitted. Each of the axles 180 is supported on a related pair of ears 18.

An impeding unit 60 is used instead of the impeding elements 25. The impeding unit 60 includes a rod 61, a wheel 62, a movable element 63, an adjusting element 64, a rod 65, two bent elements 66 and a frictional strap 67. The rod 61 is parallel to the longitudinal bar 11. The rod 61 includes an end connected to the post 13 and another end connected to the wheel 62. The frictional strap 67 is wound around the wheel 62. Each of the bent elements 66 includes an end connected to an end of the frictional strap 67 and another end pivotally connected to the movable element 63. The rod 65 is transversely connected to the rod 61. The rod 65 includes two slots 650 each for receiving a pin driven through a related one of the bent elements 66. The adjusting element 64 is inserted through the post 13. The adjusting element 64 is preferably a threaded bolt driven in a screw hole defined in the movable element 63 or engaged with a nut attached to the movable element 63. The adjusting element 64 is operable to move the movable element 63 relative to the rod 65 so that the angles of the bent elements 66 are changed. Therefore, the length of the portion of the frictional strap 67 wound around the wheel 62 is changed, and so is the stress in the frictional strap 67 as well as the friction between the wheel 62 and the frictional strap 67.

A coordinating unit 70 is used instead of the coordinating unit 30. The coordinating unit 70 includes a lever 72 and two connectors 73. The lever 72 is connected to the wheel 62 so that they can only be rotated together. Each of the connectors 73 is used to connect an end of the lever 72 to a related one of the pedal units 20.

Figure 8:
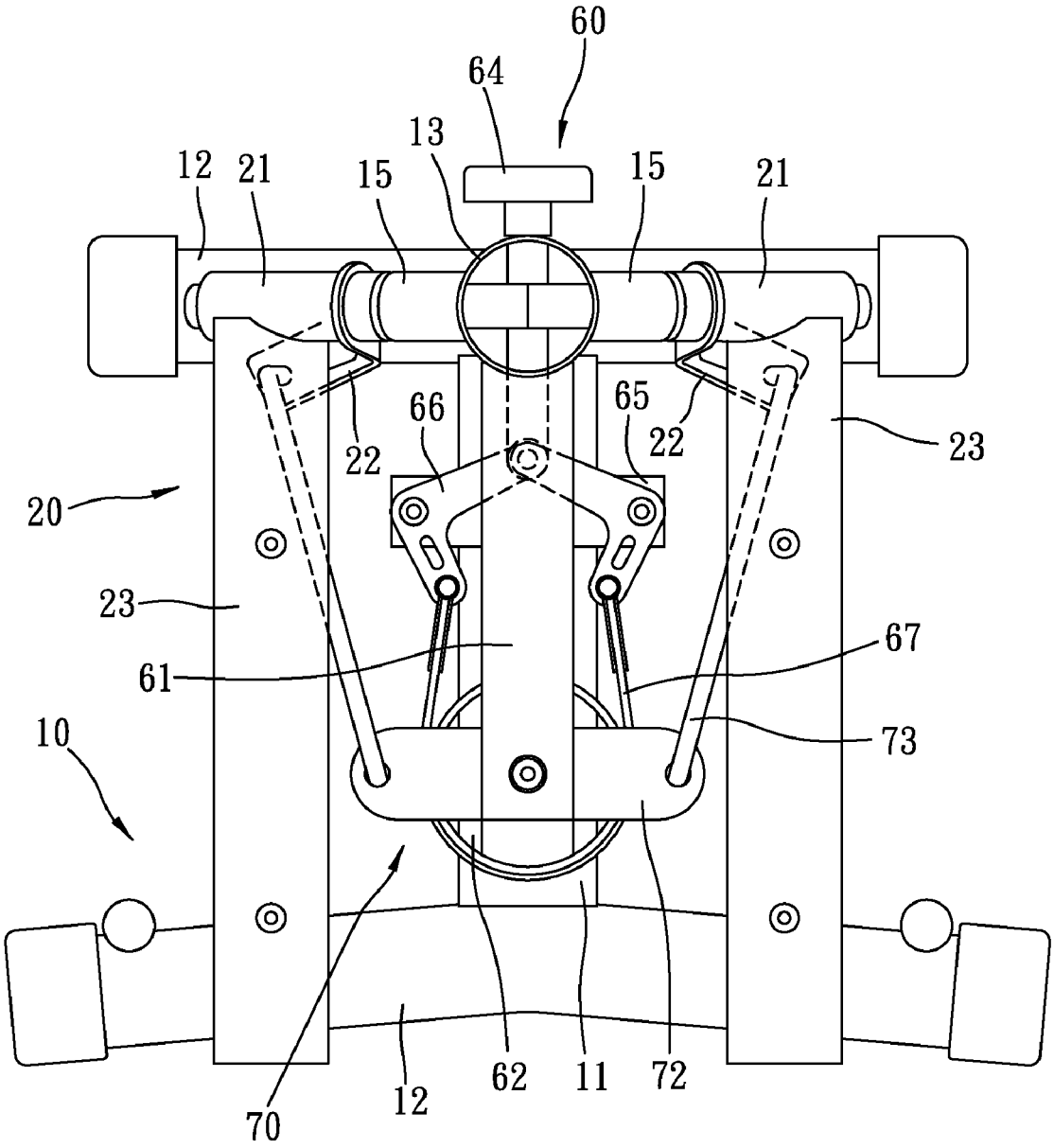
FIG. 8 is a top view of a compact stepper according to the seventh embodiment of the present invention.

Referring to FIG. 8, there is shown a stepper according to a seventh embodiment of the present invention. The seventh embodiment is like the sixth embodiment except the following features. Two axles 15 are connected to the post 13. Hence, the pairs of ears 18 and the axles 180 are omitted. The bent elements 66 are pivotally connected to the rod 65. Hence, the slots 650 are omitted. The adjusting element 64 is connected to the bent elements 66. Hence, the movable element 63 is omitted.

Figure 9:
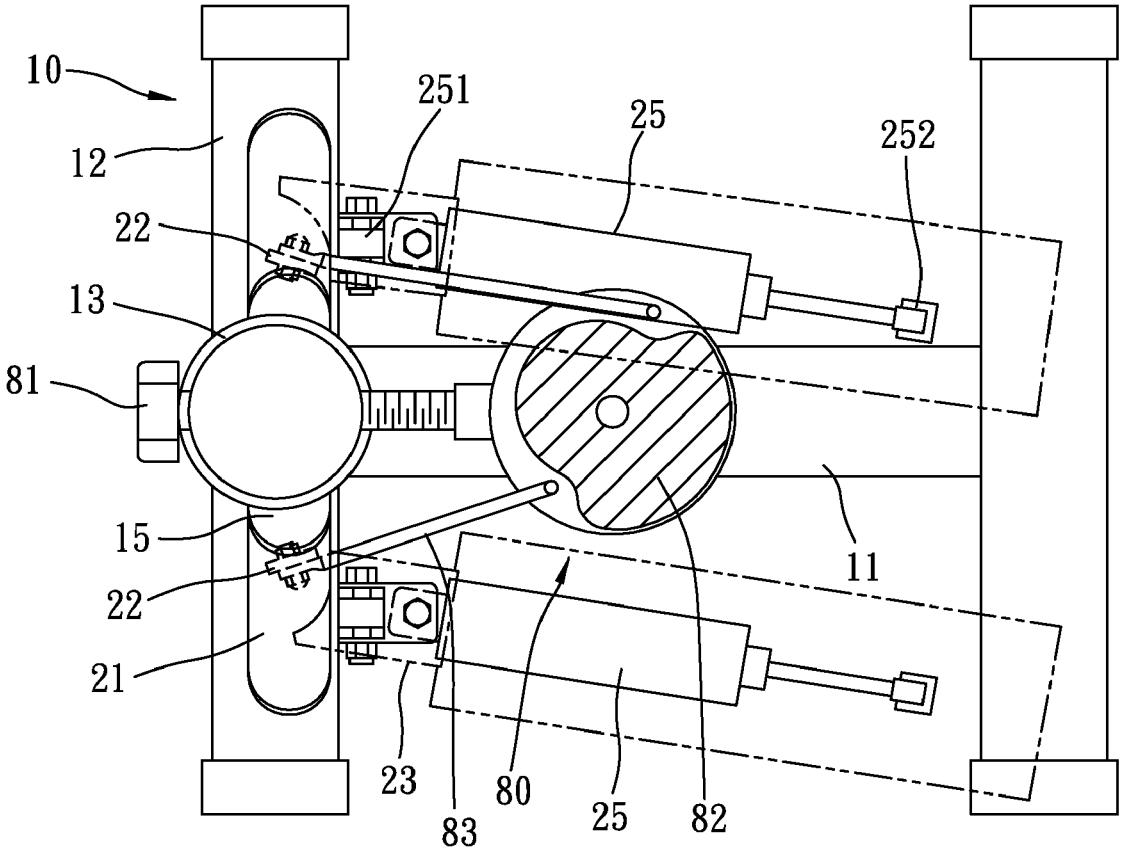
FIG. 9 is a top view of a compact stepper according to the eighth embodiment of the present invention.

Referring to FIG. 9, there is shown a stepper according to an eighth embodiment of the present invention. The eighth embodiment is like the second embodiment except the following features. A coordinating unit 80 is used instead of the coordinating unit 30. The coordinating unit 80 includes an adjusting element 81, a wheel 82 and two connectors 83. The adjusting element 81 is preferably a threaded bolt driven in a screw hole defined in the post 13. A knob is attached to an end of the adjusting element 81. The wheel 82 is pivotally connected to another end of the adjusting element 81. Each of the connectors 83 includes an end connected to the wheel 82 and another end connected to a related one of the cranks 22. By operating the adjusting element 81, the angles of the pedal units 20 are changed.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A stepper comprising:

a base having an upright post;

a bar attached orthogonally at a middle portion thereof to the post so as to extend laterally from the post;

two axles each provided at an end of the bar so that they point laterally downwards as they extend away from each other;

two pedal units each pivotally connected to a related one of the axles; and a coordinating unit having:

a frame located on a middle portion of the base;

an adjusting element engaged with the frame;

a lever connected to the adjusting element and pivotally connected to the base; and two connectors each connecting the lever to a related one of the pedal units such that as one pedal unit moves upward and outward, the other pedal unit moves inward and downward and vice versa.

2. The stepper according to claim 1 comprising a post provided on the base, wherein the axles are connected to the post.

3. The stepper according to claim 1 comprising two impeding elements each for exerting impedance against movement of a related one of the pedal units.

4. The stepper according to claim 1, wherein the coordinating unit comprises a frame provided on a front portion of the base, and the lever is pivotally connected to the frame with a fastener.

5. The stepper according to claim 1 comprising two impeding elements each comprising an end connected to the base and another end connected to a related one of the pedal units.

* * * * *